United States Patent [19]

Kushner et al.

[11] 4,087,214

[45] May 2, 1978

[54] MOTIVE FLUID SUPPLY SYSTEM FOR METERING VALVE

[75] Inventors: Jack Kushner, Lindenhurst; Henry G. Zwirblis, Nesconset, both of N.Y.

[73] Assignee: Delta Scientific Corporation, Lindenhurst, N.Y.

[21] Appl. No.: 644,171

[22] Filed: Dec. 24, 1975

[51] Int. Cl.[2] ..... B67D 5/54

[52] U.S. Cl. ..... 417/557; 222/194; 302/49

[58] Field of Search ..... 417/328, 540, 557; 222/194, 95; 138/26; 60/413, 415, 418; 92/44; 302/49, 35

[56] References Cited

U.S. PATENT DOCUMENTS

| | | | |
|---|---|---|---|
| 888,833 | 5/1908 | Miller | 417/540 |
| 1,546,706 | 7/1925 | Bezzenberger | 92/44 |
| 1,638,048 | 8/1927 | Matheson | 222/194 |
| 2,681,012 | 6/1954 | Hackman | 417/328 |
| 2,795,932 | 6/1957 | McLuen | 60/418 |
| 2,914,223 | 11/1959 | Richter | 222/194 |
| 3,806,199 | 4/1974 | Aonuma et al. | 222/194 |

*Primary Examiner*—Carlton R. Croyle
*Assistant Examiner*—Thomas I. Ross
*Attorney, Agent, or Firm*—Pennie & Edmonds

[57] ABSTRACT

An air supply system for supplying air to a periodically opened valve comprising a conduit for connecting the valve in continuous communication with a source of air and an expandable air storage chamber connected to the source of air and to the valve.

11 Claims, 3 Drawing Figures

MOTIVE FLUID SUPPLY SYSTEM FOR METERING VALVE

BACKGROUND OF THE INVENTION

In fluid analyzing systems where it is necessary to meter quantities of fluid, it is also necessary that these quantities be fed to the analyzing system in a positive, non-turbulent manner and as discrete increments of precise volume. In a typical analyzing system, a number of different reactants of precise quantity are also required for mixing with the fluid being analyzed to permit the appropriate quantitative chemical analysis of the fluid. An analyzing system of this type is disclosed in the copending application Ser. No. 501,875, filed Aug. 30, 1974, entitled "Liquid Analysis System" and now U.S. Pat. No. 3,999,545.

In such a system, the metering of the fluid and reactants is controlled by an air operated metering valve device. This device includes a tubular housing and a complementary shaped rotor valve plug mounted within the housing. The wall of the housing is provided with a plurality of passageways extending diametrically therethrough. The rotor is also provided with diametrically extending passageways. The passageways through the housing are divided into two sets, one of which is aligned with the passageways through the rotor when the rotor is in a filling position. These are the filling passageways and include an inlet and outlet on the diametrically opposite walls of the housing. The other set of passageways through a housing are aligned with the rotor when the rotor is in a dispensing position. These are the dispensing passageways. They also include an inlet and outlet on diametrically opposite walls of the housing but are aligned at right angles to the filling passageways. In the filling position of the metering device, fluid is fed through the filling passageways of the housing to fill the rotor passageways. As the rotor rotates, the charge of liquid in each rotor passageway first becomes isolated from the housing filling passageways; and then as the rotor rotates 90° to the dispensing position, they align themselves with the dispensing passageways of the housing. The inlet of each dispensing passageway in the housing is connected to a source of air pressure so that when the rotor is properly positioned, air will force the fluid in the rotor passageways out through the outlets of these passageways.

In order to smoothly and gently dispense each quantity of fluid from each of the rotor passageways and in order to do this both completely and immediately upon the rotor reaching the dispensing position, the pressure of the driving air must be carefully regulated. In a typical metering device, there may be four or five rotor passageways and a single source of compressed air used to supply air to each of the inlets of the dispensing passageways of the housing. Also, the air is supplied to these inlets continuously so that it is immediately available upon alignment of the rotor passageways with the dispensing inlets. The pressure at which the air required is on the order of 7 to 9 inches of water column. An excessive pressure will not provide the desired gentle, smooth flow. Also, an excessive pressure can cause malfunction of the metering device of this construction. This is so since the air is being continuously supplied through the inlets of the dispensing passageways and is only blocked by the wall surface of the rotor when the rotor passageways are out of alignment with these inlets. An excessive pressure will tend to cause leakage of air along the interface of the rotor and housing. This can result in further disruption of the liquid filling cycle and the proper containment of the liquid within the rotor passageways.

In order to avoid these problems, the air should be continuously supplied to the metering device at a low pressure and generally at the same pressure that will be required for forcing the liquid in each rotor passageway through the outlets of the housing dispensing passageways. However, with a single source of air supplying all of the inlets of the dispensing passageways of the housing, the demand consumption of the metering device is greater than the rate of flow of air from the source. This excess demand consumption appears even if the total cross-sectional size of the individual inlets in the housng is equal to the cross-sectional size of the conduit supplying air from the source. It is even more evident where the total size of the housing dispensing inlets is greater than the size of the conduit supplying air from the source. In any event, this excess demand consumption may require the use of a restricting device in the conduit system to avoid a high pressure system during the non-dispensing position of the rotor and to, at the same time, provide the required pressure for dispensing. Restriction devices used in this way generally require continuous monitoring to assure that the air is being properly supplied to the metering device for each position in the rotor.

SUMMARY OF THE INVENTION

In accordance with the teachings of the present invention, applicant has provided a reliable, low pressure air supply system. This system can be continuously connected to the metering valve of the type described above without danger of causing malfunction and with the assurance that a sufficient quantity of air will be available for each rotor passageway when in the dispensing position. In construction, the air supply system includes a conduit which connects each of the inlets of the dispensing passageways in the housing to a source of air under pressure. This connection provides continuous communication with the source of air. In addition, the inlets of each dispensing passageway of the housing are connected to an expandable bellows which itself is connected to the source of air. The connection of the bellows to the inlets and to the source of air also provides continuous communication between these parts of the system.

The air supply system is adapted for use for supplying air to a periodically opened valve means such as the metering device described above. During the time the inlets of the discharge passageways of the housing of the metering device are closed by alignment with the wall surface of the rotor, air from the source is collected in the bellows which expands to increase its internal volume for receiving this air. The size of the bellows is such that a sufficient quantity of air will be ready for use when the metering device is in the dispensing position. When this position is reached, the air from the source is used to push the fluid out of the rotor passageways. In addition, the air from the bellows is used as a supplemental supply for meeting the demand consumption of the metering device.

DETAILED DESCRIPTION OF THE PREFERRED EMBODIMENT

Figure 1:
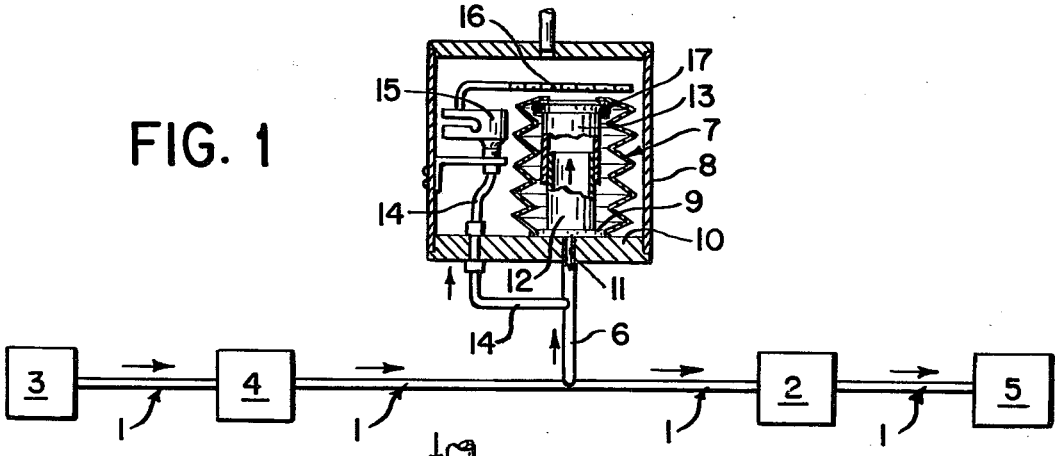
FIG. 1 is a view showing the parts of the air supply system of the present invention with the metering device and analyzing system with which it is to be used shown in block diagram.

As shown in FIG. 1, the air supply system of the present invention includes a first conduit 1 for connecting the fluid metering device 2 to a source of air 3. A pump 4 is used to supply the air at a predetermined pressure and rate. An analyzing device 5 is connected to the output of the metering device 2. The conduit 1 between the source 3 and metering device 2 is continuously open to continuously supply compressed air.

A second conduit 6 is connected to the first conduit between the source 3 and metering device 2 and leads to an expandable bellows 7. The conduit 6 is continuously open so as to continuously place the bellows in communication with both the source 3 and the metering device 2.

As shown in FIG. 1, the bellows is mounted within a housing 8. The bottom 9 of the bellows is horizontally disposed on the bottom wall 10 of the housing and has an opening 11 connected to the conduit 6 for placing the interior of the bellows in communication with the conduit. The bellows is mounted for expanding movement in a vertical direction. For this purpose, telescoping guides are internally secured to the bellows. A first guide 12 is secured to the bottom of the bellows while a second guide 13, secured to the top of the bellows, is telescopically received over the guide 12.

Also mounted internally of the housing 8 is a branch conduit 14. This conduit is connected to the conduit 6 and at its upper end includes an air bleed valve 15. The bleed valve connects the conduit 14, and thus the entire system, to atmosphere when actuated and is used as a protective device to prevent overexpansion of the bellows.

As shown in FIG. 1, the bleed valve includes an actuating arm which extends into the path of vertical movement of the bellows. In the position shown in FIG. 1, the arm is biased in a downward direction by its own weight to close the bleed valve. As the bellows expands upon receiving a quantity of air, it moves vertically upwardly and eventually into contact with the arm 16. The positioning of the arm is such that contact will be made after the internal volume of the bellows has increased to a size to hold a quantity of air sufficient for properly supplying air to the metering device when in its dispensing position. The arm is also located to make contact with the bellows before the bellows is expanded to its limit. Contact of the bellows with the actuating arm 16 will raise the arm and open the bleed valve. This will let air within the system escape to atmosphere and the bellows will stop its expanding motion and begin to deflate. It will be apparent that the bleed valve will act as a type of servo mechanism to maintain the air system full of air at the pressure at which it is supplied by the pump 4. In this way, an excessive pressure will not be built up in the system.

A control actuating weight 17 is secured to the top of the bellows internally thereof to provide a force for deflating the bellows to decrease its internal volume and force air to the metering device when its demand consumption requires this supplemental air.

Figure 2:
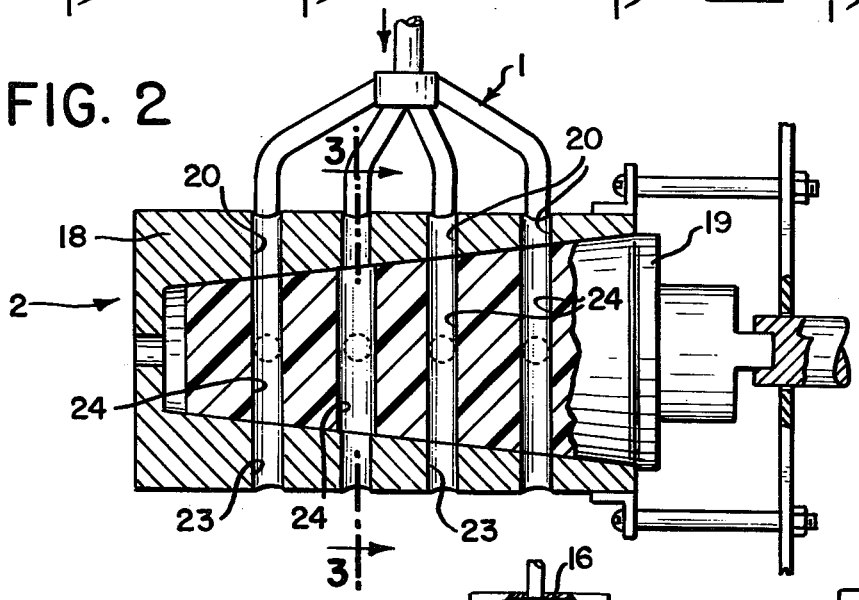
FIG. 2 is a detailed cross-sectional view of the metering device to which the air supply system of FIG. 1 is to be connected.
Figure 3:
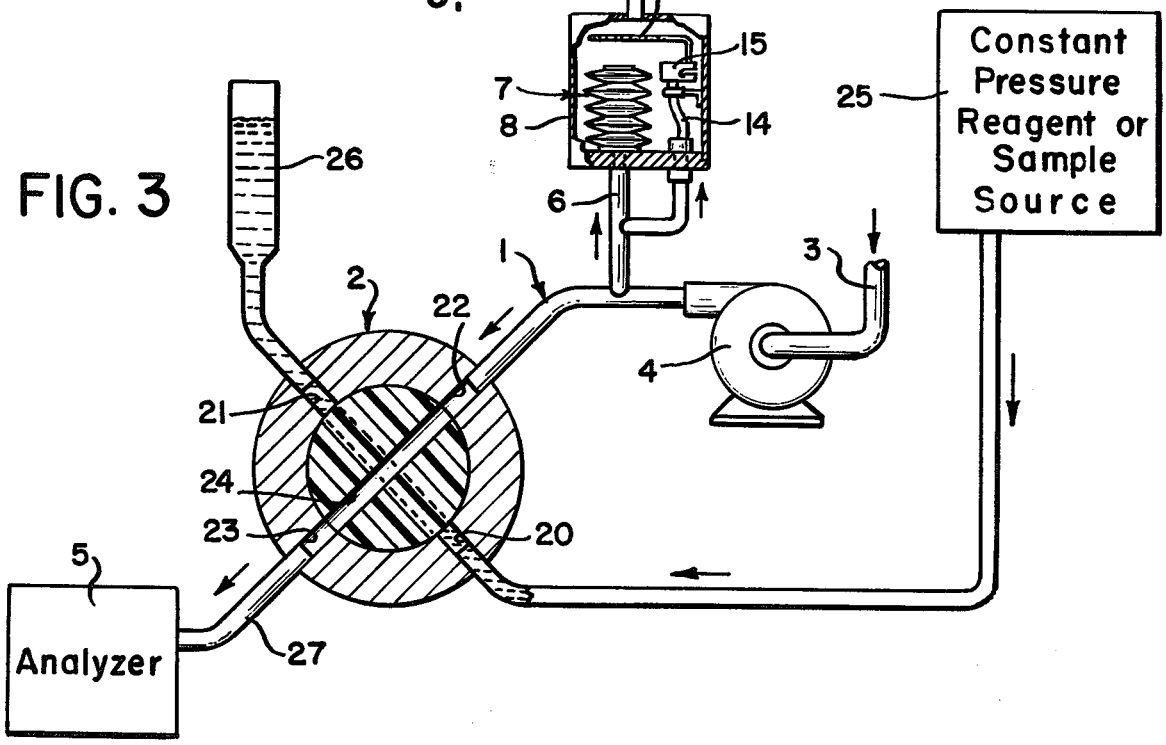
FIG. 3 is a cross-sectional view along lines 3—3 of FIG. 2 showing the metering device connected to the air supply system.

As shown in FIG. 2, the metering device 2 includes a tubular outer housing 18 and a rotor valve plug 19 rotatably mounted therein. The housing includes a set of filling passageways extending diametrically therethrough from one wall to the opposite wall. In FIG. 2, only the inlets 20 of these filling passageways are shown. FIG. 3 shows both the inlets and outlets 20, 21 of one of the filling passageways. The housing further includes a set of dispensing passageways having inlets 22 and outlets 23. The filling and dispensing passageways of the housing are disposed at right angles to each other.

For cooperating with the housing passageways, the rotor includes through passageways 24. These passageways extend diametrically across the rotor for successive alignment with the filling and dispensing passageways of the housing. As will be seen in FIG. 3, when the rotor is in a first position with its passageways, aligned with the filling passageways of the housing, as shown by the dotted lines, reagents and the sample fluid to be analyzed are fed from a source 25 to an overfill container 26 to fill the rotor passageways. In this position of the rotor, the inlets 22 of the dispensing passageways of the housing will be in continuous cmmunication with the air from the source 3 and the bellows 7. The rotor, however, will act as a valve and block the inlets 22.

After each rotor passageway is filled, the rotor moves to a second position shown in full lines in FIG. 3 where the rotor passageways are aligned with the dispensing passageways of the housing. In this position, the inlet 22 of each of the dispensing passageways of the housing is now in alignment with the associated rotor passageways 24. The rotor, functioning as a valve, has now opened the inlets 22 to permit the air in the air supply system to push the fluid contained in the rotor passageways out through the outlets 23 of the housing dispensing passageways. By suitable conduits 27, the outlets 23 will direct the discharged fluids to the analyzing device 5.

With the construction of the air supply system as described above, a sufficient amount of air will be present to satisfy the demand consumption of the metering device when the rotor valve has rotated to the open dispensing position. Supply of air from the bellows is assured by the actuating weight 17 which forces the bellows to deflate and pushes the air through the conduit and to the metering device. The size of the bellows is such that the rotor passageways have been completely evacuated of fluid prior to the bellows being completely deflated. Also, before complete deflation, the rotor has rotated past the dispensing position to once again close the inlets 22 of the dispensing passageways of the housing. The air from the source 3 therefore flows into the bellows to once again start its inflation. By the time the rotor passageways are again aligned with the dispensing passageways of the housing, the bellows will have been filled with a sufficient quantity of air for the next fluid dispensing operation. In the preferred embodiment of the metering device, the rotor is continuously rotated in one direction to move the rotor repeatedly through the filling and dispensing positions. The speed of rotation is such as to effect two complete filling and dispensing cycles per unit.

With the air supply system being used in an analyzing system having a metering device as disclosed in the copending application Ser. No. 501,875, now U.S. Pat. No. 3,999,545, the quantities of flow of fluid and the driving pressure required are very small. For example, the total quantity of fluid contained in the rotor passageways may be only 1½ mm. Also, the pump for supplying air to effect the discharge of fluid from the metering device will be of samll capacity. In a preferred construction, the pump used is a diaphragm type pump such as sold by Metaframe of East Paterson, N.J. under the name of "Hush Pump I". These pumps are typically used with fish aquariums. In the air supply system of the present invention, the pump creates a pressure of about 7 to 9 inches of water column. The main conduit leading from the pump to the metering valve will have an internal diameter of less than ⅛ of an inch. In terms of cross-sectional size, this will be about equal to the total cross-sectional size of the inlets 22 of the dispensing passageways of the metering device.

We claim:

1. An air supply system for continuously supplying air at a predetermined pressure from an air source periodically opened metering valve means wherein the valve means has a total air demand consumption greater than the rate of flow of air from the source at said predetermined pressure when the valve means is opened, comprising:

(a) a first conduit means for continuously supplying air at the predetermined pressure from the source of air directly said valve means;

(b) an expandable storage means for holding a predetermined quantity of air when expanded to an increased internal volume;

(c) second conduit means connecting the storage means to said first conduit means; and (d) actuating means for decreasing the internal volume of the storage means for forcing air therefrom to said valve means when the latter is opened.

2. An air supply system according to claim 1 further comprising:

(a) bleed valve means for opening said conduit means to atmosphere when said storage means is expanded to said increased internal volume containing said predetermined quantity of air and for maintaining said conduit means closed at all other times.

3. An air supply system according to claim 2 wherein:

(a) said second conduit means is connected to said first conduit means between said source and valve means to provide continuous communication between said source, storage means and valve means.

4. An air supply system for continuously supplying air at a predetermined pressure from an air source to periodically opened metering valve means wherein the valve means has a total air demand consumption greater than the rate of flow of air from the source at said predetermined pressure when the valve means is opened, comprising:

(a) first conduit means for continuously supplying air at the predetermined pressure from the source of air directly to the valve means;

(b) expandable bellows for holding a predetermined quantity of air when expanded to an increased internal volume;

(c) second conduit means connecting said first conduit means to said bellows for placing the bellows in continuous communication with said source and valve means;

(d) a bleed valve connected to said conduit means for connecting the conduit means to atmosphere when said bellows is expanded to said increased volume containing said predetermined quantity of air, said bleed valve having;

(1) an actuating arm operable to open said bleed valve upon movement in one direction and to close the bleed valve upon movement in the opposite direction, said arm being disposed in the path of movement of the bellows as it expands for engagement thereby and movement in said one direction when the bellows has been expanded to said increased internal volume, and (2) means for biasing said arm for movement in said other direction when not engaged by said bellows; and (e) actuating means for deflating said bellows to decrease the internal volume thereof and force air therefrom to said valve means when the latter is opened.

5. An air supply system according to claim 4 wherein:

(a) said bellows is of accordian construction with its base horizontally disposed and includes:

(1) a first guide connected to said base internally of the bellows and vertically oriented, (2) a second guide connected to the top of the bellows internally thereof and disposed in telescoping relation with said first guide to restrain expanding movement of the bellows to a vertical path; and (b) said actuating arm is disposed in the path of vertical movement of the bellows at a position to be engaged thereby prior to the bellows being expanded to its limit of expansion.

6. An air supply system according to claim 5 comprises:

(a) a tubular housing;

(b) at least one dispensing passageway extending through the housing with the inlet thereof extending through the housing wall at a first location and the outlet at a second location;

(c) a metering valve plug disposed within the housing in surface to surface contact with the inner wall surface of the housing;

(d) a through passageway in the plug for each dispensing passageway in the housing; and (e) means for mounting the valve plug for movement between a first position in which each dispensing inlet in the housing is closed by the plug and a second dispensing position in which each valve plug passageway is aligned in communication at its opposite ends with the inlet and outlet of the associated dispensing passageway in the housing.

7. The combination according to claim 6 wherein:

(a) said plug is a rotor mounted in said housing for rotation between said first and second positions;

(b) a separate filling passageway extending through the housing for each dispensing passageway, each of said inlet passageways includes an inlet extending through the housing wall at a third location and an outlet extending through the wall at a fourth location; and (c) each rotor passageway is aligned with a filling passageway in the housing when the rotor is in said first position for filling said rotor passageway.

8. The combination according to claim 7 wherein:

(a) the rotor is mounted within the housing for continuous rotation in one direction to move the rotor repeatedly through said first and second positions.

9. The combination according to claim 8 further including:

(a) pump means for supplying air from said source to said system at a contant rate to expand the bellows to its increased volume while the rotor of the valve means is rotating from said dispensing position, through said filling position and back to said dispensing position.

10. An air supply system for continuously supplying air at a predetermined pressure from an air source to periodically opened metering valve means wherein the valve means has a total air demand consumption greater than the rate of flow of air from the source at said predetermined pressure when the valve means is opened, comprising:

(a) first conduit means for continuously supplying air at the predetermined pressure from the source of air directly to the valve means;

(b) an expandable accordian bellows for holding a predetermined quantity of air when expanded to an increased internal volume and having its base horizontally disposed, said bellows including:

(1) a first guide connected to said base internally of the bellows and vertically oriented, and (2) a second guide connected to the top of the bellows internally thereof and disposed in telescoping relation with said first guide to restrain expanding movement of the bellows to a vertical path;

(c) second conduit means connecting said first conduit means to said bellows for placing the bellows in continuous communication with said source and valve means; and (d) actuating means for deflating said bellows to decrease the internal volume thereof and force air therefrom to said valve means when the latter is opened, said actuating means comprising a weight attached to the second guide at the top of the bellows.

11. A low pressure air supply system for continuously supplying air at a predetermined pressue from an air source to periodically opened metering valve means wherein the valve means has a total air demand consumption greater than the rate of flow of air from the source at said predetermined pressure when the valve means is opened, comprising:

(a) a first conduit means for continuously supplying air directly to said valve means at a pressure of between about 7 to 9 inches of water column from the source of air at the same pressure;

(b) an expandable storage means for holding a quantity of said air when expanded to an increased internal volume;

(c) second conduit means connecting the storage means to said first conduit means; and (d) actuating means for decreasing the internal volume of the storage means for forcing air therefrom to said valve means when the latter is opened.

* * * * *